US006863253B2

(12) United States Patent
Valentz et al.

(10) Patent No.: US 6,863,253 B2
(45) Date of Patent: Mar. 8, 2005

(54) SUPPORT BASE FOR EQUIPMENT

(75) Inventors: Arthur J. Valentz, Sugar Land, TX (US); John E. Nemazi, Bloomfield Hills, MI (US)

(73) Assignee: Valentz Family Limited Partnership, Houston, TX (US)

( * ) Notice: Subject to any disclaimer, the term of this patent is extended or adjusted under 35 U.S.C. 154(b) by 0 days.

(21) Appl. No.: 10/682,680

(22) Filed: Oct. 9, 2003

(65) Prior Publication Data

US 2004/0084596 A1 May 6, 2004

Related U.S. Application Data

(60) Continuation of application No. 10/128,078, filed on Apr. 23, 2002, now Pat. No. 6,663,070, which is a continuation of application No. 09/802,439, filed on Mar. 9, 2001, now abandoned, which is a division of application No. 09/455,075, filed on Dec. 6, 1999, now Pat. No. 6,324,800.

(51) Int. Cl.[7] ..... A47F 5/12

(52) U.S. Cl. ..... 248/519; 248/354.1; 248/125.8

(58) Field of Search ..... 248/354.1, 122.1, 248/125.1, 125.3, 125.8, 161, 220.22, 624, 291.1, 188.8, 188.9, 188.5, 518, 521, 398; 52/126.1

(56) References Cited

U.S. PATENT DOCUMENTS

| | | | | |
|---|---|---|---|---|
| 3,222,030 A | * | 12/1965 | Thorpe | 254/100 |
| 3,771,273 A | * | 11/1973 | Brodie | 52/646 |
| 3,889,945 A | | 6/1975 | Ellis | |
| 4,236,642 A | | 12/1980 | Klein | |
| 4,272,058 A | * | 6/1981 | Van Santen | 254/98 |
| 4,502,653 A | | 3/1985 | Curtis, Jr. | |
| 4,513,934 A | | 4/1985 | Pruyne | |
| 4,515,195 A | | 5/1985 | Gladstein | |
| 4,558,544 A | | 12/1985 | Albrecht et al. | |
| 4,658,521 A | * | 4/1987 | Thorpe | 38/102.6 |
| 4,718,355 A | | 1/1988 | Houghton | |
| 4,787,657 A | * | 11/1988 | Henniger | 285/323 |
| 4,829,732 A | | 5/1989 | Dahowski et al. | |
| 4,895,335 A | * | 1/1990 | Oliver | 248/354.3 |
| 4,989,863 A | | 2/1991 | Hall | |
| 5,072,557 A | * | 12/1991 | Naka et al. | 52/126.6 |
| 5,197,819 A | | 3/1993 | Hughes | |
| 5,217,191 A | | 6/1993 | Smith | |
| 5,232,204 A | | 8/1993 | Nunez | |
| 5,249,397 A | * | 10/1993 | Monaco | 52/126.1 |
| 5,335,377 A | | 8/1994 | Masyada et al. | |

(List continued on next page.)

OTHER PUBLICATIONS

Information Sheet, Portable Pipe Hangers, Inc., side 1 and side 2.

Portable Pipe Hangers, Inc., Zero Penetrations Book, pp. 9, 15, 21 and 29.

*Primary Examiner*—Ramon O. Ramirez
*Assistant Examiner*—Ingrid Weinhold
(74) *Attorney, Agent, or Firm*—Brooks Kushman P.C.

(57) ABSTRACT

A support base for distributing a concentrated load over a contact surface is disclosed. The support base includes a body formed of moldable polymeric material having a top surface and a generally planar bottom surface. At least one recess is integrally formed in the top surface for receiving a support member. The support member transfers the concentrated load to the planar body. Furthermore, at least one through bore is provided in the support base, and the through bore extends from the top surface to the bottom surface of the support base for receiving a fastener. The through bore has a shaft portion and a relatively oversized cavity portion adjacent to the bottom surface for receiving fasteners such as nuts for securing bolts, as well as, bolt heads of different sizes and configurations. The support base has many advantages over the prior art for example, the base may be attached to different interface bracketry without be modified.

27 Claims, 4 Drawing Sheets

U.S. PATENT DOCUMENTS 5,538,364 A * 7/1996 Huntsman ..... 405/288
5,564,669 A 10/1996 Wu
5,680,732 A * 10/1997 Skouras ..... 52/126.1
5,743,505 A 4/1998 Sofy
5,758,854 A * 6/1998 Shih ..... 248/354.3
5,788,204 A 8/1998 Goodwin et al.
5,816,554 A 10/1998 McCracken
5,820,092 A 10/1998 Thaler
5,901,525 A 5/1999 Doeringer et al.
5,911,393 A * 6/1999 Reuter ..... 248/181.1
5,913,782 A * 6/1999 Monaco et al. ..... 52/126.1
5,946,867 A 9/1999 Snider, Jr. et al.
5,960,904 A 10/1999 Ullmann
6,015,139 A 1/2000 Weber
6,079,698 A 6/2000 Patterson et al.
D435,430 S 12/2000 Valentz et al.
6,158,705 A * 12/2000 Cudmore et al. ..... 248/354.1
6,256,939 B1 * 7/2001 Snyder ..... 52/126.6
6,324,800 B1 * 12/2001 Valentz et al. ..... 52/298
6,363,685 B1 * 4/2002 Kugler ..... 52/745.05
6,364,256 B1 4/2002 Neider et al.
6,427,965 B1 * 8/2002 McCracken ..... 248/633
D463,250 S * 9/2002 Valentz ..... D8/349
6,471,176 B2 * 10/2002 Berthiaume ..... 248/523
6,592,093 B2 * 7/2003 Valentz ..... 248/346.01
6,663,070 B2 * 12/2003 Valentz et al. ..... 248/354.1
6,688,050 B2 * 2/2004 Sagiao ..... 52/126.1
2004/0026580 A1 * 2/2004 Schauer ..... 248/188.4

* cited by examiner

SUPPORT BASE FOR EQUIPMENT

This application is a continuation of U.S. application Ser. No. 10/128,078 filed on Apr. 23, 2002, now U.S. Pat. No. 6,663,070 issued on Dec. 16, 2003, which is a continuation of U.S. application Ser. No. 09/802,439 filed on Mar. 9, 2001 now abandoned which is a divisional of U.S. application Ser. No. 09/455,075 filed Dec. 6, 1999, now U.S. Pat. No. 6,324,800 issued on Dec. 4, 2001.

TECHNICAL FIELD

The present invention relates to systems for supporting and hanging pipes and other loads on rooftops.

BACKGROUND ART

It is common in a commercial industrial environment to have various operating pipes, conduits, and other equipment positioned on and extending along the ground or over the tops of roofs. For example, these pipes and conduits may be connected to an air conditioning unit positioned on a building roof.

Frequently the pipes carry fluids which have operating temperatures fluctuating over a wide range. As the temperature of the fluids carried by the pipes changes the pipes will expand or contract accordingly. Typically, the pipes may expand and contract greatly. Therefore, the support for these pipes as they run over the ground and/or over a roof must sustain the pipe load but also must be sufficiently flexible to withstand the expansion and contraction caused by fluctuations in operating parameters and the prevailing weather.

On a building roof it was common practice for operating pipes to be supported by blocks of wood. The blocks are placed at intervals along the pipe track and fit between the roof surface and the pipes. Due to the large contact surface area between the blocks and a pipe the blocks are frequently moved as the pipes expand and contract. Over a period of time, the movement of the blocks against a roof surface damage the roof. This usually resulted in a leak and required expensive roof repair. One solution used to prevent block movement was to mechanically secure the block to the roof. However, mechanical attachment such as nailing the block to the roof has been shown to deteriorate in a relatively short time period. The blocks then break loose and a leak occurs at the attachment holes. Another alternative is to penetrate the roof with a vehicle post which is attached to the building structure. Invariably the seal between the roof and the post will fail resulting in a leak.

In the roof environment, utilizing fixed bases would require holes to be placed in the roof surface. As discussed above, holes lead to leaks, a definite disadvantage of fixed bases. In general, fixed bases also lack flexibility for adjustment during set-up and use, and therefore are expensive to install.

Thus, a non-affixed base for supporting rooftop equipment has been developed in the prior art which includes a substantially flat bottom having a support structure rising from the base. The bases that have been developed typically have a plurality of recesses for attaching devices which interface and connect the pipe with the base. Some recesses generally have smooth walls and other recesses have expensive threaded metal inserts for receiving fasteners. Although these prior art non-affixed bases fulfill their intended purpose, they are not easily adaptable for attaching a variety of load interfacing devices such as bolts and brackets having different threads, attachment requirements and corrosion resistance characteristics.

Therefore, a need exists for a new and improved non-fixed portable base for supporting pipes and other equipment and is reconfigurable for attaching a variety of interfacing bracketry and support devices thereto.

DISCLOSURE OF INVENTION

Accordingly, an object of the present invention is to provide a portable support base which may be reconfigured to receive a variety of pipe and other equipment support and interface bracketry.

In accordance with this and other objects, the present invention provides a support base for distributing a concentrated load over a contact surface. The support base includes a body formed of moldable polymeric material having a top surface and a generally planar bottom surface. At least one recess integrally formed in the top surface for receiving a support member wherein the support member transfers the concentrated load to the planar body. Furthermore, at least one through bore is provided in the support base, and the through bore extends from the top surface to the bottom surface of the support base for receiving a fastener. The through bore has a shaft portion and a relatively oversized cavity portion adjacent to the bottom surface for receiving fasteners such as nuts for securing bolts, as well as, bolt heads of different sizes, configurations and materials.

In accordance with another aspect of the present invention, a support base is provided for distributing a concentrated load. The support base has a body formed of moldable polymeric material having a top surface and a generally planar bottom surface. A recess is integrally formed in the top surface for receiving a support member wherein the support member transfers the concentrated load to the planar body. An inner pair of through bores extend from the top surface to the bottom surface for receiving a fastener. The inner pair of through bore having a shaft portion and a relatively oversized cavity portion adjacent to the bottom surface. An outer pair of through bores extend from the top surface to the bottom surface for receiving a fastener. The through bores have a shaft portion and a relatively oversized cavity portion adjacent to the bottom surface.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1A:
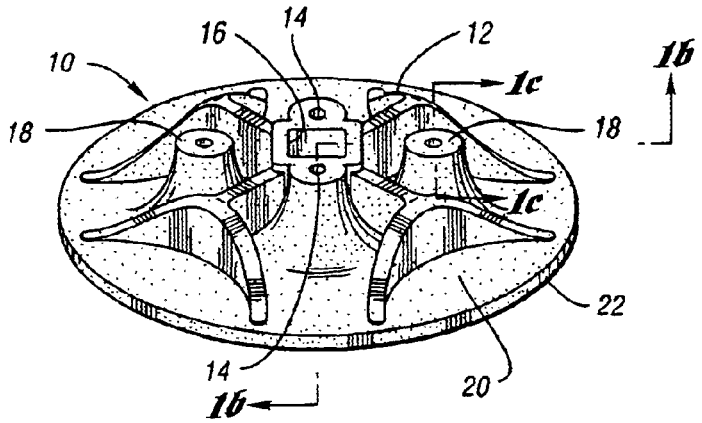
FIG. 1*a* is a perspective view of the support base according to the present invention illustrating the plurality of inner and outer apertures and the network of stiffening ridges.

With reference to FIG. 1*a*, there is shown a support base 10 for supporting a load and dispersing the load over a surface contact area. Generally, support base 10 has a network of ridges 12 which extend radially outward from a central cavity 16. Radially extending ridges 12 serve to stiffen the support base 10 and prevent it from fracturing when a concentrated load is applied. Support base 10 further includes a plurality of inner apertures 14. Inner apertures 14 are located generally adjacent to the inner cavity 16 and are configured to receive various load interfacing bracketry for interfacing the load with a support base 10. The specific configurations of the inner apertures 14 will be described hereinafter. Additionally, support base 10 has outer apertures 18 which are disposed radially outward of inner cavity 16. As with inner apertures 14, outer apertures 18 are configured to receive interfacing bracketry which interface the load with support base 10. Accordingly, the configuration of the outer apertures will be described in greater detail hereinafter.

Support base 10 may be comprised a variety of high strength low weight polymers with or without fillers or fiber reinforcement. A preferred low cost material is high density polyethylene. Moreover, the support base's overall weight 25 may be reduced by if desired introducing a gas into the injection molding process used to manufacture the support base. A preferred process for introducing the gas into the support base molding process is disclosed in U.S. Pat. No. 5,728,329 issued to Guergov and is hereby incorporated by reference. Introducing gas into the support base creates an internal void portion 19 (as shown in dotted outline in a portion of FIG. 1*b*). Internal void portion 19 displaces the polymeric material in the core of the part thereby reducing the amount of material required to form the support base and the overall weight of the base without reducing strength. A support base made from the process referenced above has many advantages over the prior art, including but not limited to, reduction in manufacturing costs and weight, reduction in surface stresses, reduced manufacturing process cycle time and reduced in shrink, sink and warpage of molded support base.

Figure 1B:
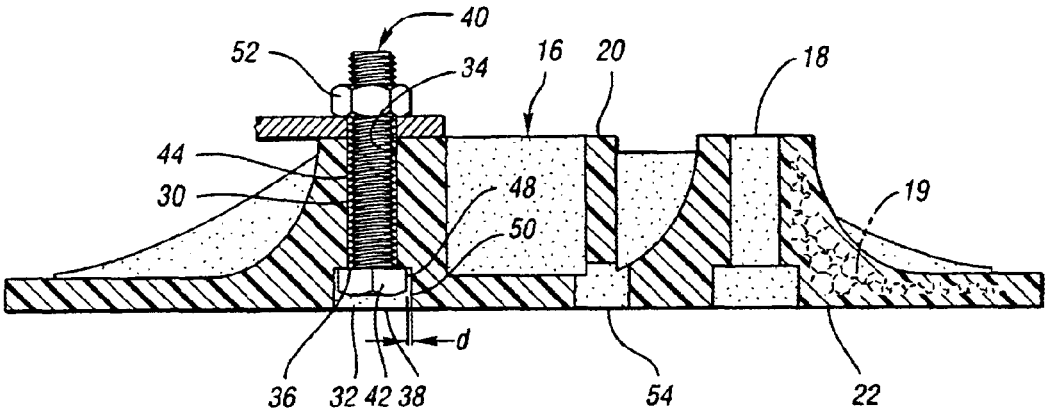
FIG. 1*b* is a cross sectional view of the support base taken along line 1*b*—1*b* through one of the inner apertures, the central cavity, and one of the outer apertures, according to the present invention.

Referring now to FIG. 1*b*, a cross-section taken through inner cavity 16, one of the inner apertures 14, and one of the outer apertures 18 is shown, in accordance with the present invention. Inner apertures or through bores 14 includes a fastener shaft portion 30 and a fastener head portion 32. Fastener shaft portion 30 has an upper end opening 34 which terminates at a top surface 20 of support base 10. A lower end opening 36 of fastener shaft portion 30 is in communication with fastener head portion 32. Accordingly, fastener head portion 32 has a lower end opening 38 which terminates at the bottom surface 22 of the support base 10.

A conventional fastener 40 is shown threaded through inner aperture 14. As shown, fastener 40 has a fastener head 42 which is positioned within the fastener head portion 32 of the inner aperture 14. A shaft portion 44 of the fastener 40 is contained within the fastener shaft portion 30 of the inner aperture 14. Fastener head 42 in one embodiment is unable to rotate within the inner aperture 14 because of the relatively small gap d between an outer surface 48 of the fastener head 42 and the inner surface 50 of the fastener head portion 32. Gap d is dimensioned such that when a torque is applied to fastener 40 fastener head surface 48 contacts the inner surface 50 and prevents fastener 40 from rotating. A locking nut 52 may be turned onto fastener 40 for preventing relative axial movement of fastener 40 within inner aperture 14.

Certainly other fasteners may be used in place of fastener 40 such as a conventional carriage bolt which has a squared off shaft portion which would be positioned within the fastener shaft portion 30. The carriage bolt would have an interference fit with the fastener shaft portion which would prevent the carriage bolt from rotating. An alternative embodiment would include a fastener head portion 32 which is significantly larger (oversized) than a fastener head. For example, gap d would be dimensioned sufficiently large enough to allow a tool such as a wrench socket to be placed over fastener head. The tool of course would be used to rotate the fastener head, to secure the fastener and associated bracketry to the support base.

A drain 54 is created in a wall of central cavity 16 to allow water or other fluids to seep out of the central cavity, as illustrated in FIG. lb. The drain prevents fluids especially water from accumulating in the central cavity. If water was allowed to accumulate in the central cavity the support posts received by the central cavity could rust and deteriorate. There are two paths by which water can exit the cavity through the bottom of the support base and through the wall of the central cavity onto the top surface of the support base. Drain 54 is preferably formed in the support base by positioning an insert in the mold used to form the support base. The insert will create a void in the support base, preventing the polymeric material used to form the base from flowing into the area taken up by the insert.

Figure 1C:
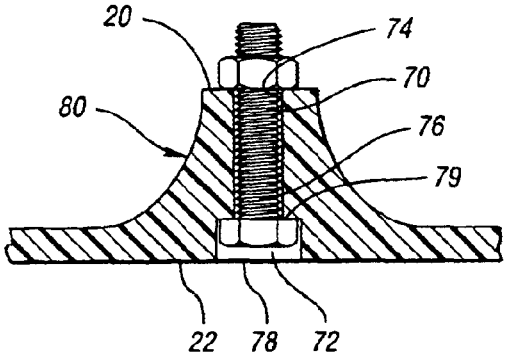
FIG. 1*c* is a cross sectional view of the support base through an outer aperture, according to the present invention.

Referring now to FIG. 1*c*, a cross-section through outer apertures 18 is illustrated. Outer aperture 18 includes a fastener shaft portion 70 and a fastener shaft head portion 72. Fastener portion 70 has an upper opening 74 which terminates at surface 20 of the support base. Shaft portion 70 has a lower end 76 which has an opening 79 which is co-terminus with the fastener head portion 72. Fastener head portion 72 has a lower end opening 78 which terminates at the bottom surface 22. Surface 20 is elevated above bottom surface 22 by a structural boss 80 which surrounds and strengthens outer aperture 18.

Figure 2:
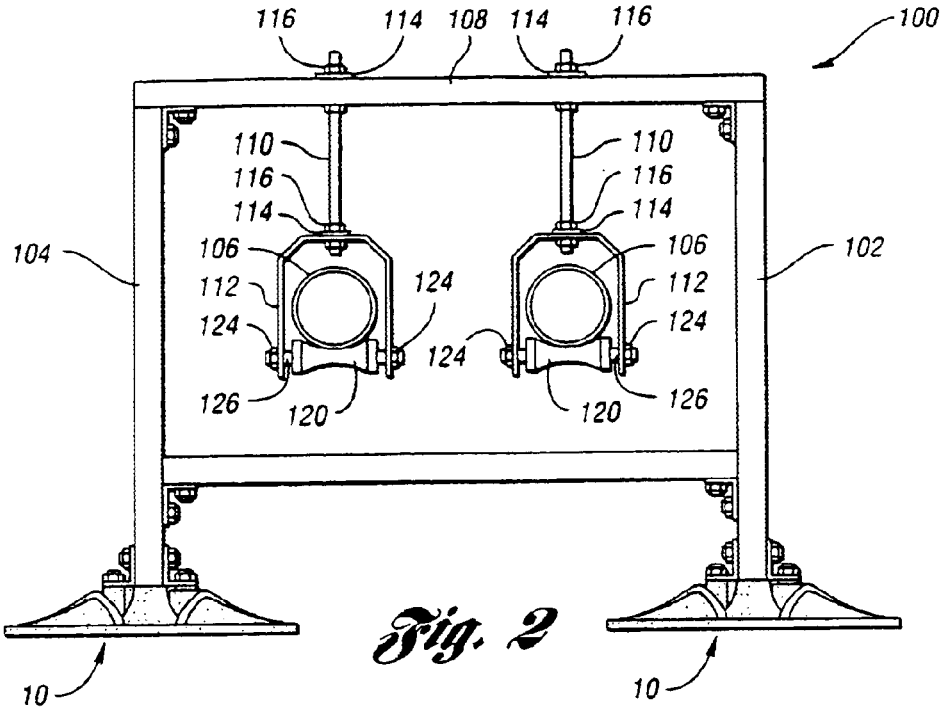
FIG. 2 is a perspective view of a pipe supporting system, having a frame and yokes for supporting pipes, the system is further shown fixedly secured to the support base, according to the present invention.

With reference to FIG. 2, an embodiment of the present invention illustrating the use of the inner cavity 16 for supporting a rooftop or ground level pipe system is shown. A frame 100 having support posts 102 and 104 and a crossbar 108 are configured to transmit the load created by pipes 106 to the support base 10. Pipes 106 are suspended from crossbar 108 which is connected to pipes 106 via threaded rods 110 and yokes 112. One end of the threaded rod 110 is secured to the yoke 112 by washers 114 and nuts 116, and the other end of threaded rod 110 is secured to the crossbar 108 with washers 114 and nuts 116. A conventional pipe support roller 120 is secured through holes in yoke 112 by nuts 124 on threaded rod 126. Threaded rod 126 securely retains pipe supported roller 120 while permitting free rotation thereof corresponding to movement of pipe 106. It will be understood that nuts 116 on threaded rod 110 may be adjusted to raise or lower the roller 120 of the yoke 112 and thus adjust for beveling pipe 106 to equalize and distribute the pipe load throughout the pipe support system.

Figure 3A:
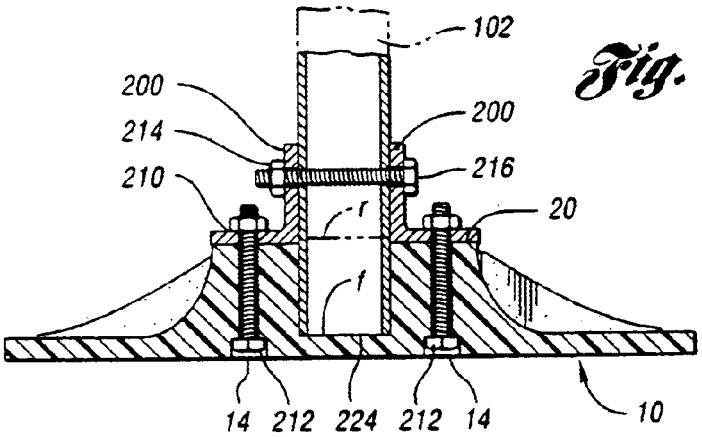
FIG. 3*a* is a cross sectional view through the support base and post configuration of FIG. 2, according to the present invention.
Figure 5:
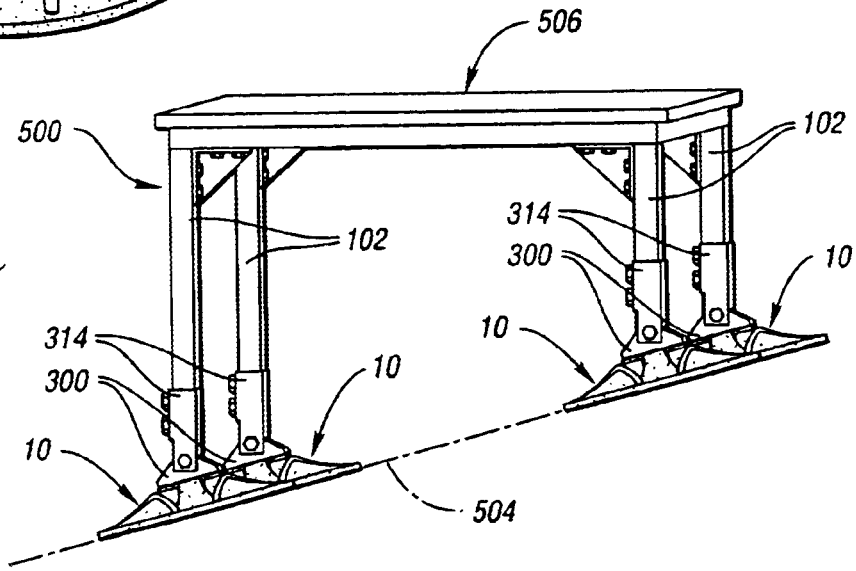
FIG. 5 is a perspective view of a platform fixedly attached to support bases for supporting equipment or providing a walkway over flat or inclined surfaces, according to the present invention.

An embodiment of the present invention including an attachment scheme for securing post 102 to the support base 10 as illustrated in FIG. 3*a*. A pair of L-brackets 200 may be securedly fixed to post 102 and to inner aperture 14 as shown. A fastener 212 is threaded through inner aperture 14 and through an L-bracket aperture 210 to secure L-bracket to the support base 10. Of course, different fasteners 212 having different fastener head configurations may be used. A post fastener 216 is shown engaging a nut 214 for clamping L-bracket 200 to post 102 of the support base 10. The post 102 may be attached to the base in at least two positions as denoted by the dotted line r and solid line f. Dotted line r signifies an attachment position for the post 102 where the post bottom 224 is elevated above surface 20 such that post bottom 224 does not engage cavity 16. Since post bottom 224 is elevated above surface 20 such that post 102 is free to rotate about the base 10 and therefore may be fixed at any desired angle with respect to the base. This attachment scheme allows the post and base assembly to seek an angle of inclination of the surface on which they rest (as shown in FIG. 5). Solid line f denotes the position of the post bottom 224 when it is fully engaged with cavity 16. In this position post 102 is not allowed to rotate about base 10 and thus will be held in an upright fixed position.

Figure 3B:
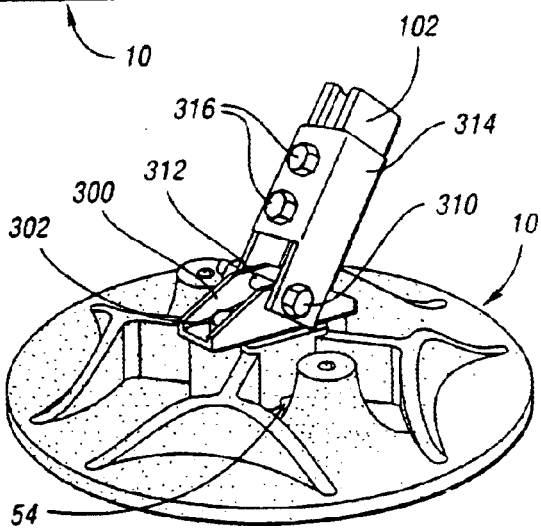
FIG. 3*b* is a perspective view of an alternative attachment scheme for fixing a post to the support base, according to the present invention.

With reference to FIG. 3*b* an alternate attachment scheme for securing support post 102 to support base 10 is illustrated. A base bracket 300 is attached via fasteners 302 threaded through inner apertures 14, as previously discussed, to support base 10. A threaded rod or bolt 310 is threaded through apertures 312 in base bracket 300 and in an intermediate bracket 314 to pivotally secure the intermediate bracket 314 to the base bracket 300. Support post 102 is then attached to the intermediate bracket 314 with nuts and bolts or the like as shown. This attachment scheme, as does the scheme in FIG. 3*a*, allows post $\mathbf{102}_{13}$ to rotate about the support base through a 180° arc.

Figure 4:
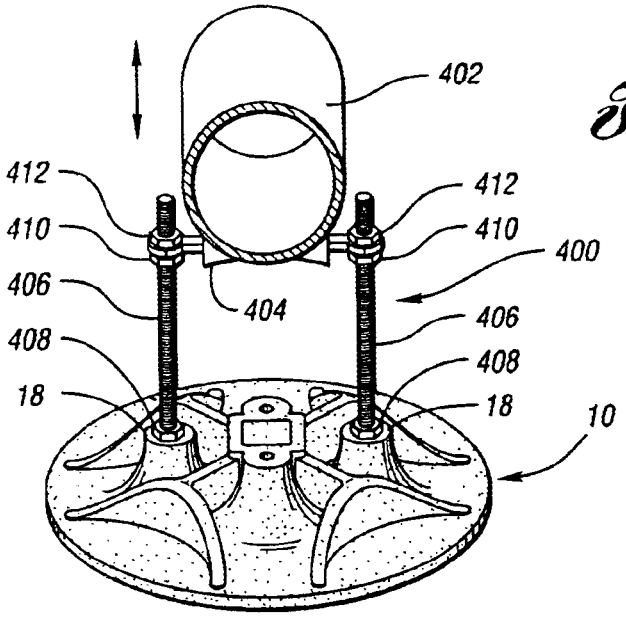
FIG. 4 is a perspective view of pipe support bracketry attached to the outer apertures of the support base for supporting a pipe, according to the present invention.

Referring now to FIG. 4, a load interface bracket 400 is shown for transmitting a load created by a pipe 402 to support base 10. Interface bracketry 400 includes a pipe roller 404 and a pair of threaded rods 406. Pipe roller 404 allows the pipe 402 to move laterally (as indicated by the arrows shown) to accommodate pipe contraction and expansion. Threaded rods 406 are threaded through outer apertures 18 and locked in place by locking nuts 408. Pipe roller 404 may be positioned vertically above support base 10 by adjusting locking nuts 410. Pipe roller locking nuts 412 are turned onto threaded rod 406 to secure the roller 404 and prevent vertical movement thereof. This pipe supporting scheme further illustrates an additional way to utilize the features of the present invention.

With reference now made to FIG. 5, a frame structure 500 is used to support a walkway, pipes, or other equipment over an inclined surface 504. The bracketry shown in FIGS. 3*a* and 3*b* may be utilized to accommodate the angle of the inclined surface 504. The frame structure 500 may be used to support equipment such as telephone switches or air conditioners or alternatively used to support a platform 506 over which a walkway may be constructed. The support base 10 seeks the angle of inclination of the inclined surface so that the support posts 102 are plum and the frame structure and platform is level with the ground.

Figure 6:
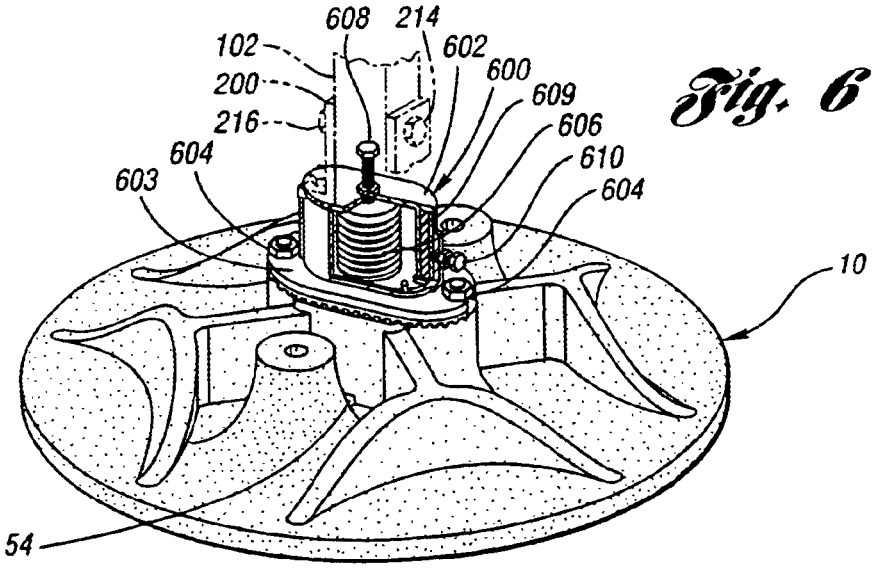
FIG. 6 is a perspective view of a shock isolation device fixedly attached to a support base for preventing shock and vibration generated by equipment attached to the mounting surface of the isolation device from being transmitted to the surface upon which the support base is resting, according to the present invention.

FIG 6 shows an isolation device 600 which may be used with support base 10 of the present invention. Isolation device 600 has a mounting surface 602 upon which post 102 may be securedly attached. For example, post 102 may be secured to surface 602 via the L-brackets 200 shown in phantom with reference to FIG. 3a. Attachment notches 604 are disposed on each side of an attachment frame 603 of isolation device 600 for securedly fixing the device to the inner apertures 14 as conventionally known (with bolts, screws, etc.). A shock and vibration absorber 606 such as a spring isolates the mounting surface 602 from the attachment frame 603. The stiffness of the absorber may be regulated using a set-screw 608. Tightening the set-screw 608 reduces vertical movement and limits bounce. Additionally, a neoprene insert 609 is disposed between a side wall of the mounting surface 602 and a side wall of the attachment frame 603 to dampen shock and vibration in the horizontal direction. A snubber screw 610 is provided to limit the amount of motion in the horizontal direction. Tightening the snubber screw 610 reduces movement and limits bounce and also controls rock. Wear of the neoprene material is negligible as damping is provided by viscous-distortion of the neoprene inserts. The above-described isolation device and support base combination provides a means to prevent shock and vibration generated by equipment, such as, motors attached to surface 602 from being transmitted to a surface the support base 10 is resting on.

Figure 8:
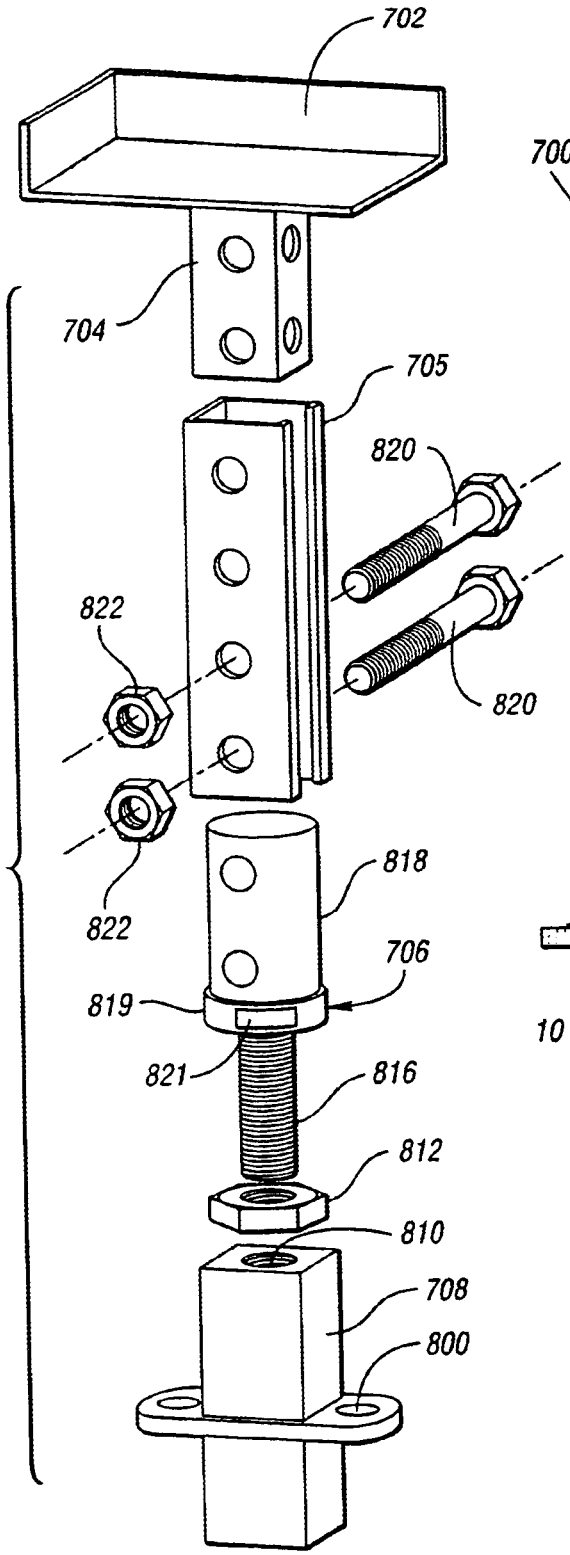
FIG. 8 is an exploded view of the adjustable post apparatus of FIG. 7 for supporting and leveling equipment supported thereon, according to the present invention.
Figure 7:
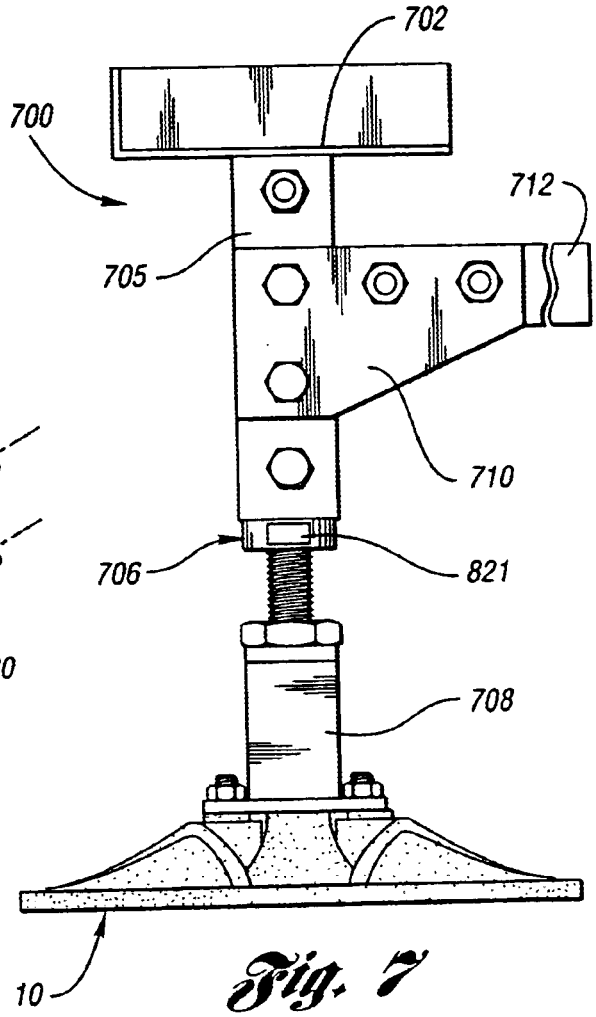
FIG. 7 is a perspective view of an adjustable post apparatus fixedly attached to the support base for supporting and leveling equipment supported thereon, according to the present invention.
Figure 9:
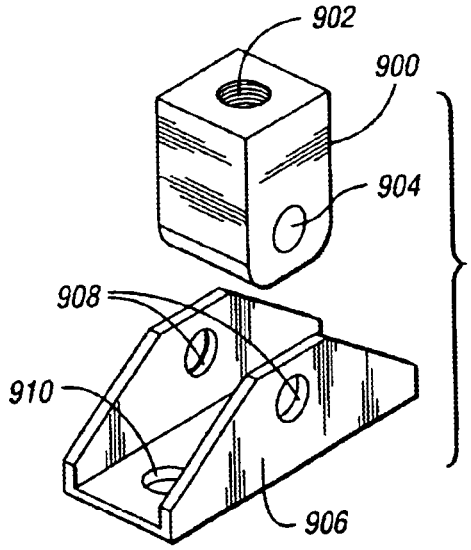
FIG. 9 is an perspective view of post attachment bracketry for adapting the adjustable post apparatus of FIG. 7 to pivot about the support base, according to the present invention.

Reference is now made to FIGS. 7 through 9 wherein an adjustable post 700 and support base 10 are illustrated, according to the present invention. FIG. 7 shows the adjustable post 700 secured at one end to the support base 10 with conventional fasteners. The other end of the adjustable post 700 has a support tray 702 fixedly secured thereon by similar means. A load is received by support tray 702 such as a roof top air conditioning unit. Support tray 702 is slidably received within a fixed post 705 and attached thereto. Fixed post 705 has a longitudinal body with a C-shaped cross section, four sides and a plurality of attachment apertures on each of the four sides.

A coupler plate 710 is attached to the fixed post 705 for joining a cross brace 712 to adjustable post 700. As readily apparent the cross brace 712 is used to secure two adjustable posts together. An adjustment screw 706 is disposed between the fixed post 705 and the attachment block 708 and may be turned into or out of the attachment block to lower or raise the adjustable post 700, respectively.

An exploded view of the adjustable post 700 is illustrated in FIG. 8. The adjustable post 700 is comprised of four main segments: the tray 702 having a locking block 704 integral thereto, fixed post 705 having a plurality of attachment apertures, an adjustment screw 706 having a fixed cylindrical end 818, collar 819 having a pair of flats 821 and a threaded end 816, and attachment block 708 having a threaded aperture 810 and attachment eyelets 800. The adjustable post is assembled by attaching the tray 702 to the fixed post 705 with fasteners then fastening the fixed post to the fixed cylindrical end 818 of the adjustable screw 706 with fasteners such as nuts 822 and bolts 820. A locking nut 812 is threaded onto threaded portion 816, and then threaded portion 816 is turned into threaded aperture 810 of attachment block 708. The attachment block may be secured to a base, such as base 10, using fasteners threaded through attachment eyelets 800 and into the base, as shown in FIG. 7. With bolts 820 removed a user can adjust the height of post 700 by turning adjusted screw 706 using a wrench engaging flats 821.

An alternative attachment block 900 and attachment bracket 906, as illustrated in FIG. 9, may be used with the adjustable post 700 for use on inclined surfaces such as shown in FIG. 5. In practice threaded end 816 would be turned into threaded aperture 902 and a fastener would be threaded through apertures 904 and 908 to pivotally secure attachment block 900 to attachment bracket 906. The entire assembly may be secured to a support base using fasteners through apertures 910 and inner apertures 14 of the support base, as previously shown and described.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A device for adjusting a height of a load supported upon a plurality of base members each having a square recessed opening formed therein, the device comprising:

a fixed post having a generally square cross-section, an upper end, a lower end and an internal cavity;

an adjustment screw including:

a cylindrical end having a diameter dimensioned to fit within the internal cavity for removable attachment thereto, a threaded bolt end, and a collar portion disposed between the cylindrical end and the threaded bolt end, the collar portion being sufficiently larger than the cylindrical diameter to prevent the fixed post from sliding over the collar portion;

an attachment block removably attached to a support base for securing the support post thereto, the attachment block having a threaded aperture for receiving the threaded bolt end; and a coupler plate for securing a cross brace to the fixed post for joining the support post to a member;

wherein the adjustment screw may be turned into the threaded aperture to change the height of the support post.

2. The device of claim 1 further comprising a locking fastener cooperating with the adjustment screw wherein the locking fastener may engage the attachment block for maintaining the adjusted height.

3. The device of claim 1 wherein the attachment block is fastened to the support base.

4. The device of claim 1 wherein the attachment block is received within a recess formed in a top surface of the support base.

5. The device of claim 1 wherein the attachment block includes a lower portion sized to be received in a recess formed in a top surface of the support base, the attachment block includes a bracket for fastening the attachment block to the support base.

6. The device of claim 1 wherein the attachment block includes a rotatable attachment block portion pivotally fixed to an attachment bracket portion for rotating the support post about the support base.

7. The device of claim 1 wherein the collar portion further comprises a pair of diametrically opposed flats to allow gripping engagement of a tool for rotating the adjustment screw.

8. The device of claim 1 further comprising an isolation device affixed to the post and to the support base for preventing shock and vibration occurring in the load from being transmitted to the support base.

9. A frame structure for supporting equipment on a building rooftop, the frame structure comprising:

at least four posts generally vertically extending between an equipment frame and the building rooftop upon which the frame structure is mounted, each of the four posts having an upper end adapted to receive a corner of the frame at spaced apart locations and a lower end adjacent the rooftop; and at least four support bases each cooperating with one of the lower ends of each of the at least four posts and having a body defining a planar bottom surface for cooperating with the rooftop and a top surface including a recess for receiving the lower end of a post, the top surface being adapted to mount a bracket thereto;

wherein at least one post is attached to the corresponding support base by including a bracket that is adapted to be fastened to the corresponding support base top surface and the bracket is pivotally connected to the post lower end for pivoting the post relative to the support base; and wherein at least two of the at least four posts are telescopically adjustable to vary the post length in order to adjust the level of the equipment frame relative to the rooftop, each of the at least two adjustable posts having a pair of cooperating threaded members, which when relatively rotated, cause the length of the post to gradually vary.

10. The frame structure of claim 9 wherein at least one post is attached to the corresponding support base by the post lower end being received in the corresponding base recess.

11. The frame structure of claim 9 wherein the base is formed of a moldable polymeric material.

12. The frame structure of claim 9 wherein at least one of the at least four support posts lower ends includes an attachment block removably attached to the corresponding support base for securing the respective post thereto.

13. The frame structure of claim 12 wherein the attachment block includes a lower portion sized to be received in the corresponding base recess, and a bracket for fastening the attachment block to the base.

14. The frame structure of claim 12 wherein the attachment block includes a rotatable attachment block portion pivotally fixed to an attachment bracket portion for rotating the support post about the support base.

15. A frame structure for supporting equipment on a building rooftop, the frame structure comprising:

a platform for supporting a load;

at least four posts generally vertically extending between the platform and the building rooftop upon which the frame structure is mounted, each of the four posts having an upper end attached to the platform at spaced apart locations and a lower end adjacent the rooftop; and at least four support bases each cooperating with one of the lower end of each of the at least four posts and having a body defining a planar bottom surface for cooperating with the rooftop and a top surface including a recess for receiving the lower end of a post, the top surface being adapted to mount a bracket thereto;

wherein at least one post is attached to the corresponding support base by including a bracket that is adapted to be fastened to the corresponding support base top surface and the bracket is pivotally connected to the cost lower end for pivoting the post relative to the support base; and wherein at least two of the at least four posts are telescopically adjustable to vary the post length in order to adjust the level of the platform relative to the rooftop, each of the at least two adjustable posts having a pair of cooperating threaded members, which when relatively rotated, cause the length of the post to gradually vary.

16. The frame structure of claim 15 wherein at least one post is attached to the corresponding support base by the post lower end being received in the corresponding base recess, and the at least one post includes a bracket that is adapted to be fastened to the corresponding support base top surface.

17. The frame structure of claim 15 wherein at least one of the at least four support posts lower ends includes an attachment block removably attached to the corresponding support base for securing the respective post thereto.

18. The frame structure of claim 17 wherein the attachment block includes a lower portion sized to be received in the corresponding base recess, and a bracket for fastening the attachment block to the base.

19. A frame structure for supporting equipment on a building rooftop, the frame structure comprising:

at least four posts generally vertically extending between an equipment frame and the building rooftop upon which the frame structure is mounted, each of the four posts having an upper end adapted to receive a corner of the frame at spaced apart locations and a lower end adjacent the rooftop; and at least four support bases each cooperating with one of the lower ends of each of the at least four posts and having a body defining a planar bottom surface for cooperating with the rooftop and a top surface including a recess for receiving the lower end of a post, the top surface being adapted to mount a bracket thereto;

wherein at least one post is attached to the corresponding support base by the post lower end being received in the corresponding base recess, or by including a bracket that is adapted to be fastened to the corresponding support base top surface;

wherein at least two of the at least four posts are telescopically adjustable to vary the post length in order to adjust the level of the equipment frame relative to the rooftop, each of the at least two adjustable posts having a pair of cooperating threaded members, which when relatively rotated, cause the length of the post to gradually vary; and wherein at least one of the at least four support posts lower ends includes an attachment block removably attached to the corresponding support base for securing the respective post thereto and the attachment block includes a rotatable attachment block portion pivotally fixed to an attachment bracket portion for rotating the support post about the support base.

20. The frame structure of claim 19 wherein at least one post is attached to the corresponding support base by the post lower end being received in the corresponding base recess, and the at least one post includes a bracket that is adapted to be fastened to the corresponding support base top surface.

21. The frame structure of claim 19 wherein at least one post includes a bracket that is adapted to be fastened to the corresponding support base top surface and the bracket is pivotally connected to the post lower end for pivoting the post relative to the support base.

22. The frame structure of claim 19 wherein the base is formed of a moldable polymeric material.

23. The frame structure of claim 19 wherein the attachment block includes a lower portion sized to be received in the corresponding base recess, and a bracket for fastening the attachment block to the base.

24. A frame structure for supporting equipment on a building rooftop, the frame structure comprising:

a platform for supporting a load;

at least four posts generally vertically extending between the platform and the building rooftop upon which the frame structure is mounted, each of the four posts having an upper end attached to the platform at spaced apart locations and a lower end adjacent the rooftop; and at least four support bases each cooperating with one of the lower ends of each of the at least four posts and having a body defining a planar bottom surface for cooperating with the rooftop and a top surface including a recess for receiving the lower end of a post, the top surface being adapted to mount a bracket thereto;

wherein at least one post is attached to the corresponding support base by the post lower end being received in the corresponding base recess, or by including a bracket that is adapted to be fastened to the corresponding support base top surface;

wherein at least two of the at least four posts are telescopically adjustable to vary the post length in order to adjust the level of the platform relative to the rooftop, each of the at least two adjustable posts having a pair of cooperating threaded members, which when relatively rotated, cause the length of the post to gradually vary; and wherein at least one of the at least four support posts lower ends includes an attachment block removably attached to the corresponding support base for securing the respective post thereto and the attachment block includes a rotatable attachment block portion pivotally fixed to an attachment bracket portion for rotating the support post about the support base.

25. The frame structure of claim 24 wherein at least one post is attached to the corresponding support base by the post lower end being received in the corresponding base recess, and the at least one post includes a bracket that is adapted to be fastened to the corresponding support base top surface.

26. The frame structure of claim 24 wherein at least one of the at least four support posts lower ends includes an attachment block removably attached to the corresponding support base for securing the respective post thereto.

27. The frame structure of claim 26 wherein the attachment block includes a lower portion sized to be received in the corresponding base recess, and a bracket for fastening the attachment block to the base.

* * * * *

UNITED STATES PATENT AND TRADEMARK OFFICE

CERTIFICATE OF CORRECTION

PATENT NO. : 6,863,253 B2
DATED : March 8, 2005
INVENTOR(S) : Arthur J. Valentz et al.

It is certified that error appears in the above-identified patent and that said Letters Patent is hereby corrected as shown below:

Column 9,
Line 10, delete "cost" and insert therefor -- post --.

Signed and Sealed this

Tenth Day of May, 2005

JON W. DUDAS
*Director of the United States Patent and Trademark Office*